US005868408A

United States Patent [19]

Miller

[11] Patent Number: 5,868,408

[45] Date of Patent: Feb. 9, 1999

[54] TURF BOARD

[75] Inventor: Shawn T. Miller, St. Paul, Minn.

[73] Assignee: M & R Innovations LLC, Plymouth, Minn.

[21] Appl. No.: 768,294

[22] Filed: Dec. 17, 1996

[51] Int. Cl.[6] ..... A63C 17/02

[52] U.S. Cl. ..... 280/87.042; 280/842; 280/11.28

[58] Field of Search ..... 280/842, 11.28, 280/11.3, 11.31, 87.041, 87.042

[56] References Cited

U.S. PATENT DOCUMENTS

| | | | |
|---|---|---|---|
| 1,603,529 | 10/1926 | Faust . | |
| 2,545,543 | 3/1951 | Bottrill | 280/11.23 |
| 2,899,209 | 9/1959 | Reynolds et al. | 280/11.2 |
| 2,953,389 | 9/1960 | Green et al. | 280/87.04 |
| 3,288,251 | 11/1966 | Sakwa | 188/29 |
| 3,389,922 | 6/1968 | Eastin | 280/11.23 |
| 3,436,088 | 4/1969 | Kunselman | 280/11.1 |
| 3,522,951 | 8/1970 | Tyson | 280/11.1 |
| 3,545,779 | 12/1970 | Simms | 280/11.28 |
| 3,684,305 | 8/1972 | McDonald et al. | 280/11.19 |
| 3,767,220 | 10/1973 | Peterson | 280/11.2 |
| 3,884,486 | 5/1975 | Wilje | 280/11.2 |
| 3,926,449 | 12/1975 | Wilje | 280/11.23 |
| 3,945,655 | 3/1976 | Banks et al. | 280/11.2 |
| 4,045,046 | 8/1977 | Taylor et al. | 280/87.04 A |
| 4,050,705 | 9/1977 | Kreis | 280/11.1 BT |
| 4,070,065 | 1/1978 | Heitfield | 301/5.3 |
| 4,076,266 | 2/1978 | Krausz | 280/87.04 A |
| 4,082,306 | 4/1978 | Sheldon | 280/87.04 A |
| 4,133,546 | 1/1979 | Rosenblum | 280/11.1 BT |
| 4,134,600 | 1/1979 | McDonald et al. | 280/87.04 A |
| 4,176,850 | 12/1979 | Johnson | 280/87.04 A |
| 4,700,958 | 10/1987 | Volpato | 280/11.1 BT |
| 4,943,075 | 7/1990 | Gates | 280/842 |
| 5,114,166 | 5/1992 | McCosker | 280/11.28 |
| 5,125,687 | 6/1992 | Hwang | 280/842 |
| 5,135,244 | 8/1992 | Allison | 280/11.28 |
| 5,195,781 | 3/1993 | Osawa | 280/842 |
| 5,251,934 | 10/1993 | Gates | 280/842 |
| 5,263,725 | 11/1993 | Gesmer et al. | 280/11.28 |

*Primary Examiner*—Richard M. Camby
*Attorney, Agent, or Firm*—Kinney & Lange

[57] ABSTRACT

The present invention provides a turf board for simulating snowboarding on snowless terrain. The turf board includes a platform, two wheel assemblies and two bindings. Each of the wheel assemblies includes tires independently attached to a bottom surface of the platform by a shock absorber suspension. In a preferred embodiment, each of the wheel assemblies include a unique, three-piece rim which maintains the tire. The two bindings are attached to a top surface of the platform for securing a user to the turf board.

17 Claims, 9 Drawing Sheets

TURF BOARD

BACKGROUND OF THE INVENTION

The present invention relates to a turf board for simulating snowboarding. More specifically, the present invention provides a turf board having specialized suspension and wheels for use on vegetated or otherwise snowless terrain.

The sport of snowboarding has achieved immense popularity over the past several years. Similar to downhill skiing, snowboarding typically takes place at a downhill ski slope, with the "snowboarder" riding or otherwise maneuvering the snowboard down a snow-covered hill. A standard snowboard includes a single platform to which two bindings are attached. The platform is normally made from fiberglass reenforced plastic and is customized in size and shape. These shapes can include sharp edges to effectuate turns, and a curvature of some type on the bottom of the platform to provide a smooth ride.

Snowboarding is a winter sport unique unto itself in that both feet of the snowboarder are held on a single board, as opposed to two individual skis. However, snowboarding does have one key similarity with downhill skiing. Namely, both snowboarding and skiing require snow. The standard snowboard has a basically flat bottom which will not slide on a rough surface. Therefore, a snowboarder is unable to practice or simulate snowboarding in the summer time or at locations where there is no snow.

Skateboards are somewhat similar to snowboards in that a user places both feet on a single platform. A standard skateboard includes two sets of wheels attached to the bottom of the platform. The user simply propels the platform so that the wheels ride along a sidewalk or other hard surface. Therefore, it may, at first glance, appear as though a standard skateboard could be ridden down an uncovered hill so that snowboarding could be practiced without snow. However, the skateboard has many design constraints which prevents it from being a viable vehicle for snowboarding in the summer months.

A typical skateboard does not include bindings. Thus, when attempting to "ride" a skateboard down a hill, any slight loss of balance will cause the user to fall off. Further, hills, when not covered with snow, often include rough terrain, such as grass, sticks, small rocks, etc. The standard skateboard design cannot encounter these terrain obstacles without breaking down. For example, the wheel design of a skateboard is made for riding along a relatively smooth surface, such as a paved road. When the rough terrain of a turf covered hill is encountered, the skateboard wheel integrity will quickly deteriorate, resulting in severe damage to both the skateboard and possibly the rider. The same is true with respect to the suspension system. The normal skateboard simply bolts a central bracket of the wheel assembly to the platform with little thought to suspension. If a user were to ride a skateboard down a turf covered hill, any obstacles encountered would transfer a force or "jolt" to the rider, likely causing him or her to fall. Finally, the skateboard platform is normally low to the ground due to a low wheel height. As a result, the platform would often run directly into many obstacles, once again causing a fall.

Thus, because avid snowboarders desire to practice their skills in the summer time or at locations where there is no snow, a need exists for a turf board which is specially designed to handle the harsh terrain of a turf covered hill, thus simulating snowboarding.

SUMMARY OF THE INVENTION

The present invention provides a turf board for simulating snowboarding on snowless terrain. The turf board includes a platform, two wheel assemblies and two bindings. Each of the wheel assemblies is attached to a bottom surface of the platform, and provides independent suspension. In this regard, the wheel assemblies utilize a hinge plate which harnesses two lever arms and two shock absorbers. In a preferred embodiment, each of the wheel assemblies includes a unique, three-piece rim which maintains a tire. The two bindings are attached to a top surface of the platform for securing a user to the turf board.

DETAILED DESCRIPTION OF THE PREFERRED EMBODIMENTS

Figure 1:
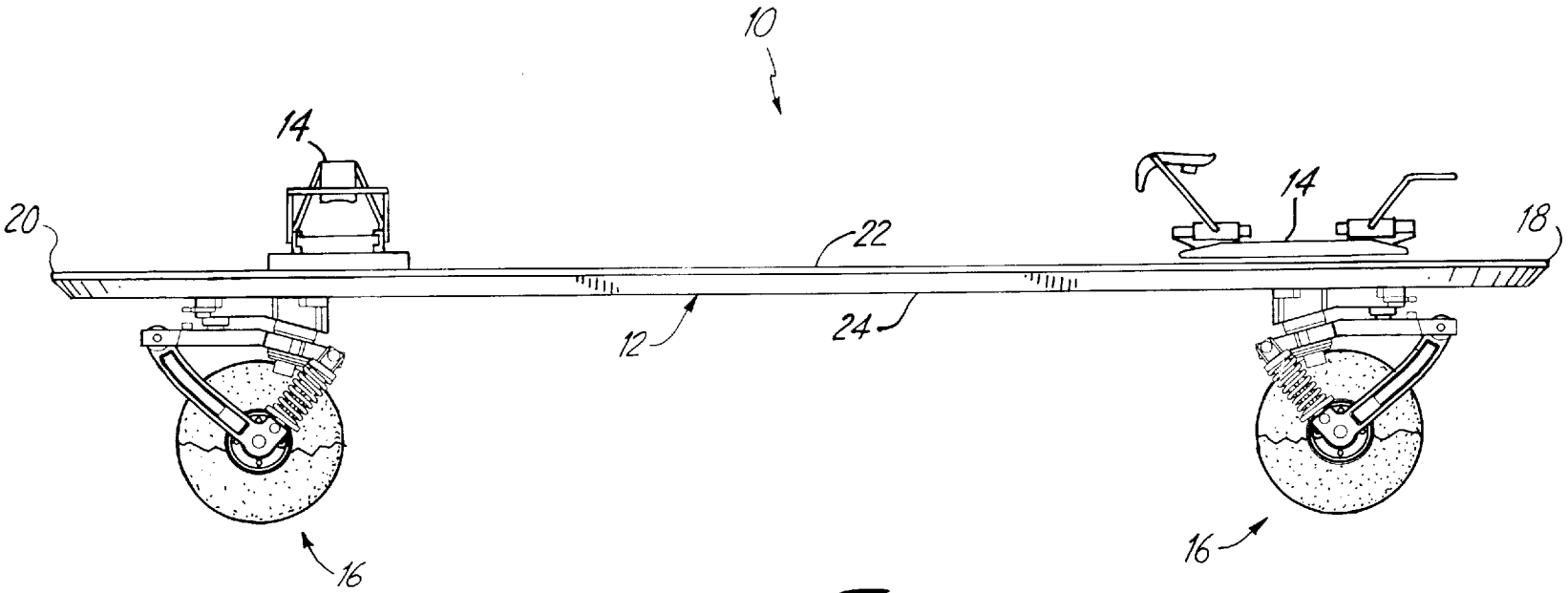
FIG. 1 is a side view of a preferred turf board in accordance with the present invention.

FIG. 1 is a side view of a turf board 10 of the present invention. Generally, the turf board 10 includes a platform 12, bindings 14 and wheel assemblies 16.

The platform 12, which is similar in design and shape to boards commonly used for snowboarding, includes a front end 18, a rear end 20, an upper surface 22 and a lower surface 24. The platform 12 is preferably formed from fiberglass reinforced plastic, although, as will be obvious to those skilled in the art, a variety of other materials, such as fiberglass reenforced wood, may also be used. The dimensions of the platform 12 may be varied according to the size and weight of a user of the turf board 10. While the platform 12 is shown as being relatively flat, the platform 12 can be designed to effectuate a bend at the front end 18 and the rear end 20. For example, the front end 18 and the rear end 20 can be manufactured separately, with a middle section disposed between the front end 18 and the rear end 20, at a position several inches below a common plane of the front end 18 and the rear end 20.

The bindings 14 are similar to those bindings commonly used in the sport of snowboarding. The bindings 14 are positioned on the platform 12 and connected to the upper surface 22 in any suitable manner, such as by bolting. As shown in FIG. 1, the bindings 16 are generally located above the wheel assemblies 16. As is commonly known in the sport of snowboarding, the bindings 14 secure the platform 12 to a user of the turf board 10. Alternatively, the bindings 14 of FIG. 1 can be replaced by simple straps. Even further, the bindings 14 can be removed and the upper surface 22 of the platform 22 roughened or otherwise textured to frictionally maintain a user's feet.

As shown in FIG. 1, the wheel assemblies 16 are identically constructed. The wheel assemblies 16 are attached to the lower surface 24 of the platform 12 in an opposing fashion. In other words, the wheel assembly 16 near the front end 18 is orientated opposite the wheel assembly 16 near the rear end 20.

Wheel Assembly 16

Figure 2:
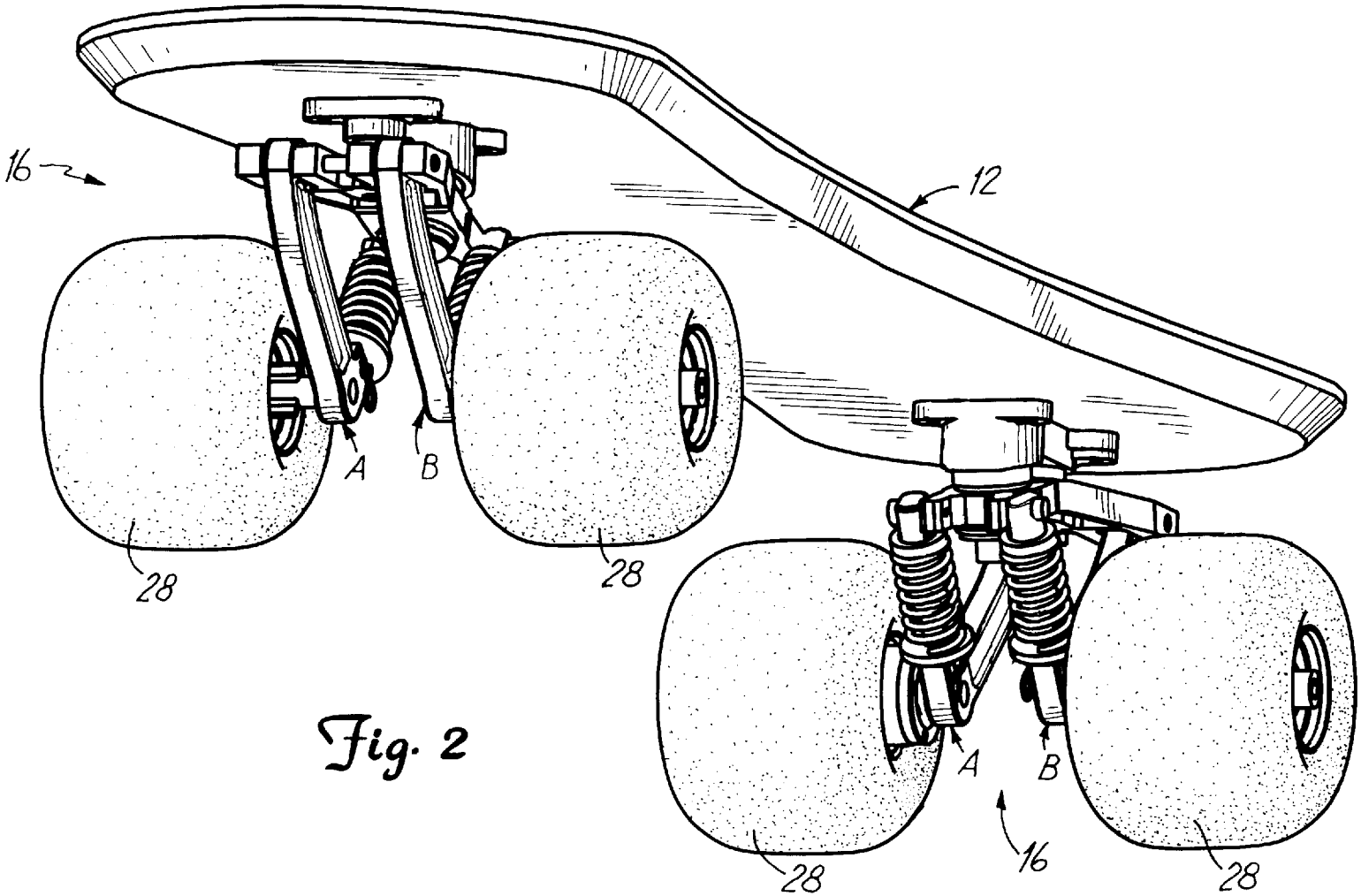
FIG. 2 is a bottom perspective view of the preferred turf board of the present invention.

As shown in FIG. 2, each of the identically constructed wheel assemblies 16 has bilateral symmetry. For purposes of clarity, the platform 12 is shown without the bindings 14 (FIG. 1). Generally speaking, the wheel assembly 16 essentially comprises independent suspensions A, B to which one of two tires 28 are connected, respectively. Thus, in construction and operation, the wheel assembly 16 has bi-lateral symmetry.

Figure 3:
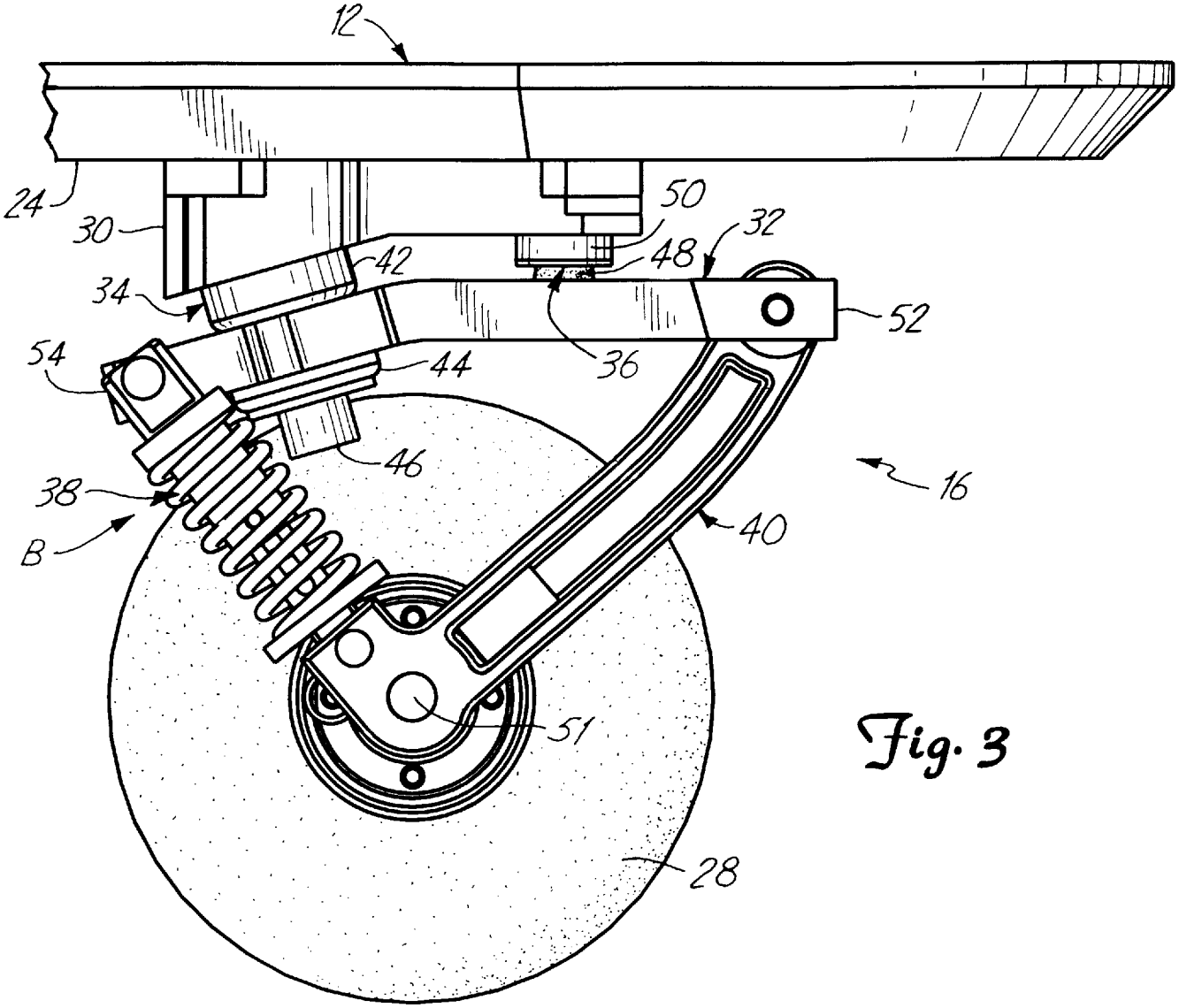
FIG. 3 is an enlarged side view of a wheel assembly of the turf board of the present invention.

FIG. 3 provides greater details on the wheel assembly 16. To more clearly depict the wheel assembly 16, the bindings 14 (FIG. 1) are not shown. The wheel assembly 16 includes a base plate 30, a hinge plate 32, a truck assembly 34, a spud assembly 36, the independent suspension B and the tire 28. It should be recalled from FIG. 2 that the independent suspensions A and B are constructed in bilateral symmetry. Therefore, FIG. 3 only shows one of the independent suspensions B. The independent suspension B includes a spring assembly 38 and a lever arm 40.

The base plate 30 is attached to the lower surface 24 of the platform 12, preferably by bolting. However, other forms of attachment are equally acceptable.

The base plate 30 is connected to the hinge plate 32 by the truck assembly 34 and the spud assembly 36. The truck assembly 34 includes an upper cushion 42, a lower cushion 44 and a bolt 46. The upper cushion 42 seats between the base plate 30 and the hinge plate 32. The lower cushion 44 seats against the hinge plate 32. The bolt 46 passes through the lower cushion 44, the hinge plate 32, the upper cushion 42 and attaches to the base plate 30 to secure the hinge plate 32 relative to the base plate 30. In this regard, the upper cushion 42 and the lower cushion 44 are made of flexible, resilient material, such as hardened rubber, so as to elastically connect the hinge plate 32 and the base plate 30. The truck assembly 34 is similar to cushions or trucks used on most skateboards. The truck assembly 34 provides for a smoother ride by deflecting or cushioning the forces acting on the wheel assembly 16, including the tires 26, 28. Additionally, the truck assembly 34 provides a user with control over the turf board 10 in that the user can transfer a turning motion by leaning toward an edge of the platform 12. This directional force is transposed through the truck assembly 34 to the hinge plate 32 and subsequently to the pair of wheels 28.

The hinge plate 32 is further connected to the base plate 30 by the spud assembly 36. As shown in greater detail below, the spud assembly 36 includes a spud 48 extending from the hinge plate 32 into a spud receptacle 50 in the base plate 30. The spud assembly 36 provides additional support between the base plate 30 and hinge plate 32. Further, the spud assembly 36 is configured such that a user can transpose a turning force through the platform 12 onto the pair of wheels 28, via the connecting spud 48.

The base plate 30 and the hinge plate 32 are preferably configured to position the truck assembly 34 in an angular fashion with respect to the platform 12. This preferred positioning orientates the truck assembly 34 in a plane similar to that formed by the spring assembly 38. With this configuration, forces applied to either the truck assembly 34 or the spring assembly 38 will be directed between the two components with little torque or additional stress on the hinge plate 32. Further, as shown in FIG. 3, the truck assembly 34 and the spud assembly 36 are preferably positioned on the hinge plate 32 such that the truck assembly 34 is on one side of a central wheel axle 51, and the spud assembly 36 is on the other side. This configuration enhances stability of the wheel assembly 16 as forces applied via the base plate 30 will not cause the hinge plate 32 to tip or unduly rotate with respect to the central wheel axle 51.

In addition to the spud 48, the hinge plate 32 includes a hinge end 52 and a suspension end 54. The hinge end 52 is pivotally attached to the lever arm 40. The suspension end 54 is connected to the spring assembly 38. Further details on the hinge plate 32 configuration are provided below.

The spring assembly 38 is attached to the suspension end 54 of the hinge plate 32. The spring assembly 38 is described in greater detail below.

The lever arm 40 is attached to and is harnessed by the hinge end 52 of the hinge plate 32. Further, the lever arm 40 is connected to the wheel 28 and the spring assembly 38. In this regard, the lever arm 40 and the spring assembly 38 are preferably disposed in an identical vertical plane.

Further details on each of the components comprising the wheel assembly 16 are provided below. Generally speaking, however, the wheel assembly 16 is uniquely designed to provide a durable suspension system for the user of the turf board 10. By including a pair of the lever arms 40 and two of the spring assemblies 38, each of the wheels 28 is provided with independent suspension. In other words, during use, one of the pair of wheels 28 can move in a vertically fashion with respect to the platform 12, for example in response to an obstacle, while the other wheel 28 remains in full contact with the ground. Further, the hinge plate 32 essentially isolates the base plate 30 and the platform 12 from the pair of wheels 28. Thus, the wheels 28 can encounter a wide variety of severe terrain with minimal impact on the platform 12, and thus the user. At the same time, the hinge plate 32 allows the user to exert turning forces on the wheel assembly 16 to provide necessary control. Finally, the wheel assembly 16 is designed to withstand large impacts. For example, the user can land after a four foot drop with no damage to the wheel assembly 16. The spring assembly 38 and the truck assembly 34 absorbs the majority of such an impact. By connecting each of the lever arm 36 directly to the hinge plate 32 and the spring assembly 38, resulting stresses on the central wheel axle 51 are minimized. This effect is further enhanced by positioning the spring assembly 38 and the lever arm 40 in a similar vertical plane.

Base Plate 30

Figure 4A:
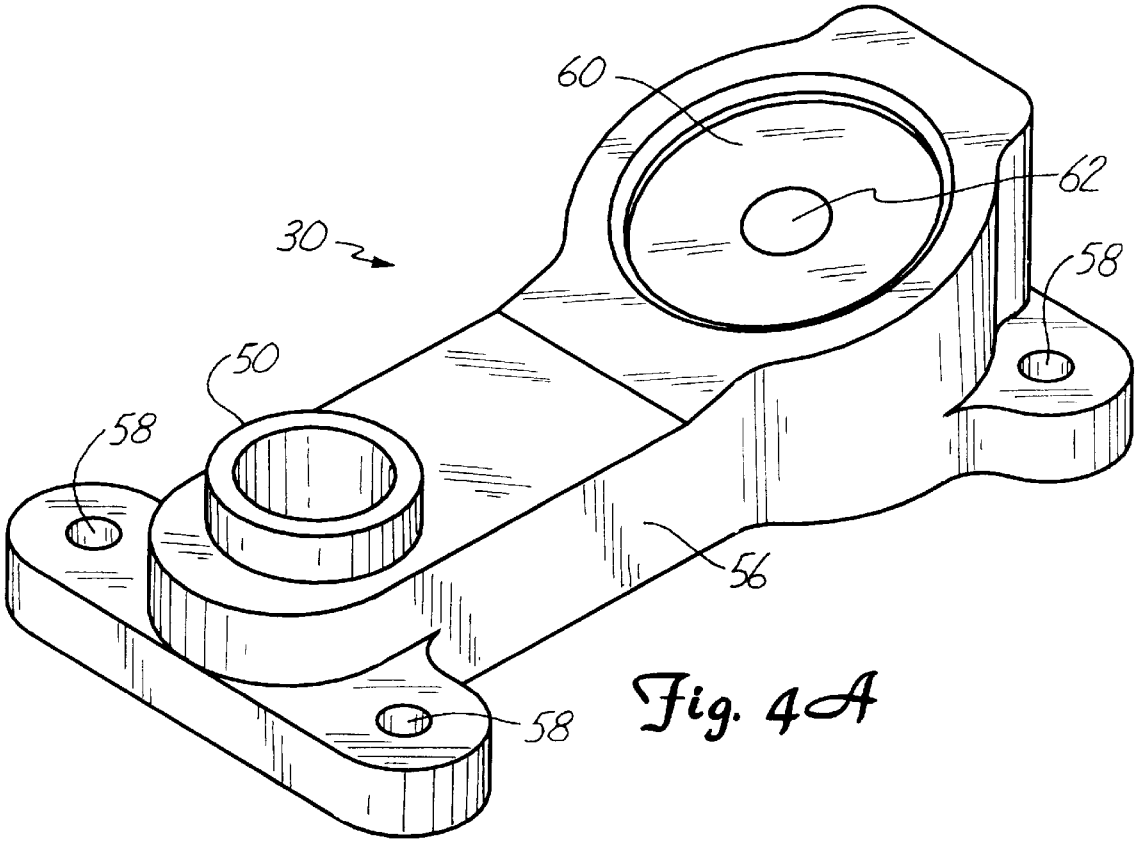
FIG. 4A is a perspective view of a wheel assembly base plate of the turf board of the present invention.
Figure 4B:
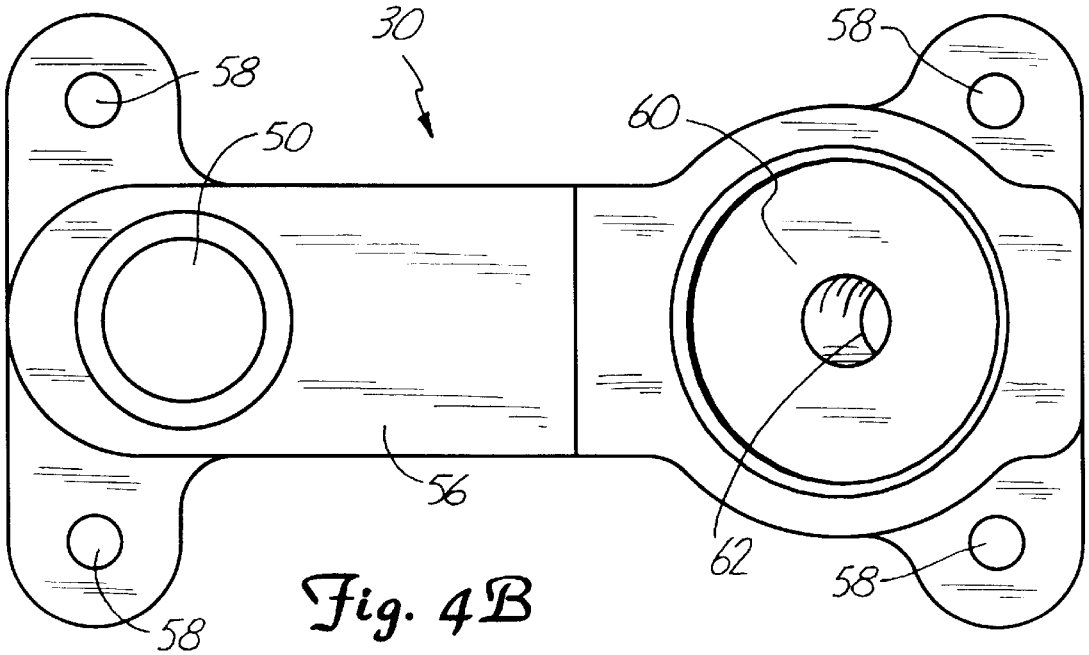
FIG. 4B is a top view of the wheel assembly base plate shown in FIG. 4A.

Further details on the base plate 30 are provided in FIGS. 4A and 4B. The base plate 30 includes a frame 56, bolt holes 58, the spud receptacle 50 and a cushion receiving recess 60. As shown in FIGS. 4A and 4B, the recess 60 and the spud receptacle 50 are located on opposite ends of the frame 56. The bolt holes 58 are disposed on outer corners of the frame 56 and provide for attachment to the platform 12 (FIG. 3). In other words, the bolt holes 58 receive bolts (not shown) that in turn are affixed to the platform 12 (FIG. 3).

The spud receptacle 50 extends from the frame 56 and is orientated in a plane which is parallel to the bolt holes 58. The spud receptacle 50 is sized to receive the spud 48 (FIG. 3). In a preferred embodiment, the spud receptacle 50 includes a bushing (not shown), made from rubber for example, to assist in maintaining the spud 48. The spud receptacle 50 allows the spud 48 to move into and out of the spud receptacle 50 in response to movement of the hinge plate 32 (FIG. 3) relative to the platform 12 (FIG. 3). The spud receptacle 50 also permits the spud 48 to pivot within the spud receptacle 50 in response to a turning force placed on the platform 12. The spud 48 and the spud receptacle 50 further act as a stop to prevent the hinge plate 32 from contacting the base plate 30 during use and maintains the spud 48 such that a turning force can be applied.

The cushion receiving recess 60 extends from the frame 56 in a plane that is angularly displaced relative to the spud receptacle 50. At the center of the cushion receiving recess 60 is a bolt passage 62. The bolt passage 62 is preferably threaded and sized to receive the bolt 46 (FIG. 3) of the truck assembly 34 (FIG. 3). The cushion receiving recess 60 is sized to receive and seat the upper cushion 42 (FIG. 3) of the truck assembly 34.

In the preferred embodiment, the base plate 30 is made from aluminum. However, other types of strong, yet lightweight materials, such as stainless steel, are equally acceptable.

As previously described, the cushion receiving recess 60 is angularly positioned relative to the spud receptacle 50. This angular orientation provides maximum support and responsiveness to the wheel assembly 16 (FIG. 3). Forces transmitted via the wheels 28 (FIG. 2) to the base plate 30 are dispersed such that a minimal resulting force is placed on the platform 12 (FIG. 3). Conversely, the angular orientation of the cushion receiving recess 60 allows a user to transmit a turning force through the base plate 30 to the wheels 28.

Hinge Plate 32

Figure 5A:
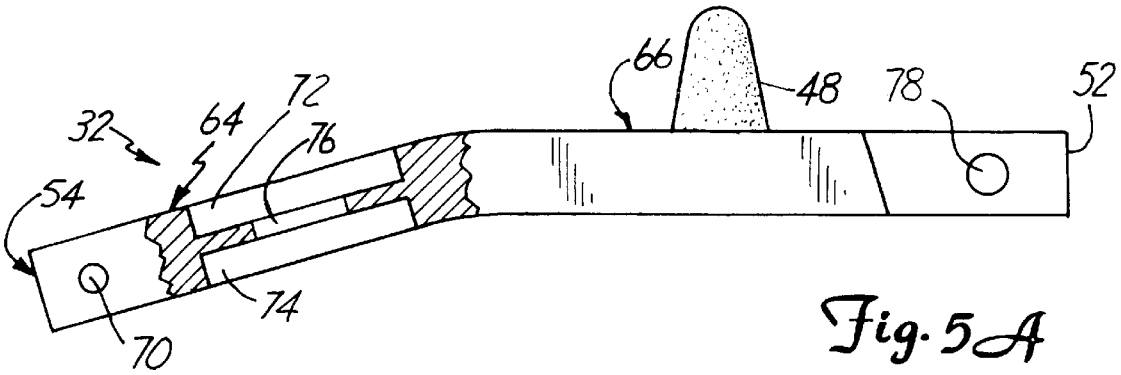
FIG. 5A is a side view of a wheel assembly hinge plate.
Figure 5B:
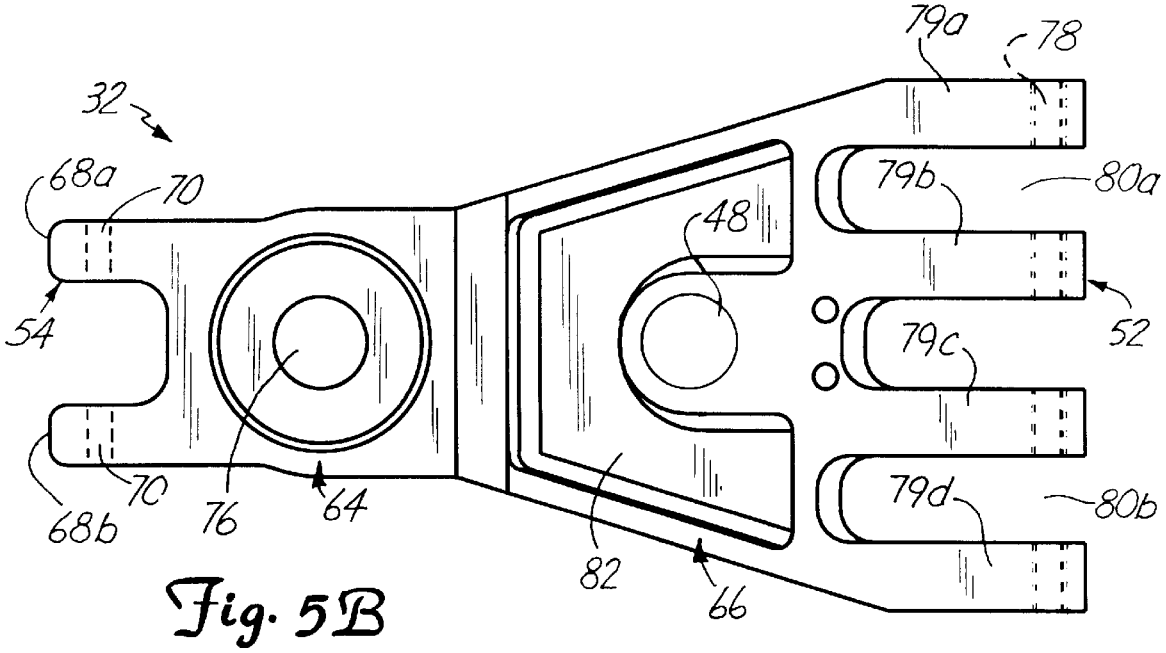
FIG. 5B is a top view of the wheel assembly hinge plate shown in FIG. 5A.

FIGS. 5A and 5B provide further details on the hinge plate 32. The hinge plate 32 includes the suspension end 54, an intermediate portion 64, a flanged portion 66, the spud 48 and the hinge end 52. The suspension end 54 includes a bore 70. The intermediate portion 64 extends from the suspension end 54 and includes an upper recess 72, a lower recess 74 and a bolt passageway 76. The flanged portion 66 extends in an angular fashion from the intermediate portion 64 and includes the spud 48. Finally, the hinge end 52 is attached to the flanged portion 66 and includes a dowel passageway 78.

The suspension end includes opposing prongs 68*a* and 68*b*. The bore 70 in the opposing prongs 68*a* and 68*b* is sized to receive a threaded stud (not shown) to attach the prongs 68*a* or 68*b* of the hinge plate 32 to the spring assembly 38 (FIG. 3). Further details on the connection between the suspension end 54 and the spring assembly 38 (FIG. 3) are provided below.

The intermediate portion 64 extends from the suspension end 54 and is preferably cylindrical in shape. More particularly, the upper recess 72 and the lower recess 74 are sized to receive the upper cushion 42 (FIG. 3) and the lower cushion 44 (FIG. 3), respectively, of the truck assembly 34 (FIG. 3). Thus, the upper cushion 42 seats within the upper recess 72 of the intermediate portion 64. Similarly, the lower cushion 44 seats within the lower recess 74 of the intermediate portion 64. The truck assembly 34 components 42, 44 are maintained in the preferred seating arrangement by the bolt 46 (FIG. 3) which passes through the central passageway 76.

As previously described, the flanged portion 66 extends in an angular fashion from the intermediate portion 64, and maintains the spud 48. In the preferred embodiment, the spud 48 is manufactured from a rubber material and is press fitted into an opening in the flanged portion 66. Alternatively, the flanged portion 66 and the spud 48 can be manufactured as a single piece. In either case, the spud 48 is sized to fit within the spud receptacle 50 (FIG. 4B) of the base plate 30 (FIG. 4B). As shown in FIG. 3, upon final assembly, the spud 48 interacts with the spud receptacle 50 in a vertical fashion.

The hinge end 52 includes fingers 79*a*–79*d* which define a first arm receiving area 80*a* and a second arm receiving area 80*b*. The fingers 79*a*–79*d* each include the dowel passageway 78. The first and second arm receiving areas 80*a* and 80*b* are sized to receive the lever arm 40 (FIG. 3). Thus, the lever arm 40 is maintained within the first arm receiving area 80*a* or the second arm receiving area 80*b* by way of a dowel pin (not shown) directed through the dowel passageway 78. In the preferred embodiment, the dowel passageway 78 includes an oil lite bearing (not shown). With this configuration, the lever arm 40 is harnessed in a pivoting fashion by the hinge plate 32 at the hinge end 52. Further, as shown in greater detail below, the lever arm 40 is in communication with the suspension end 54 by way of the spring assembly 38 (FIG. 3). By extending the hinge end 52 outwardly with respect to the intermediate portion 64, torque generated on the hinge plate 32 by a turning maneuver is minimized In a preferred embodiment, the hinge plate 32 is made of aluminum. Other similar materials, such as stainless steel, can also be used. Further, the flanged portion 66 is shown in FIG. 5B as including a cavity 82 in an upper surface. The cavity 82 is provided simply to reduce necessary material, and therefore costs. However, the cavity 82 is not required for proper functioning of the hinge plate 32.

The hinge plate 32 is an important feature of the wheel assembly 16 (FIG. 3). Unlike a standard skateboard, the hinge plate 32 provides for independent suspension. The hinge plate 32 allows each of the lever arms 40 (FIG. 3) and attached wheels 28 (FIG. 2) to move independent of one other and of the platform 12 (FIG. 3). Further, the hinge plate 32 allows a user to exert turning forces on the wheel assembly 16. Finally, the hinge plate 32 provides a unique cantilevered support system in which the wheel assembly 16 can handle large forces while maintaining integrity.

Lever Arm 40

Figure 6A:
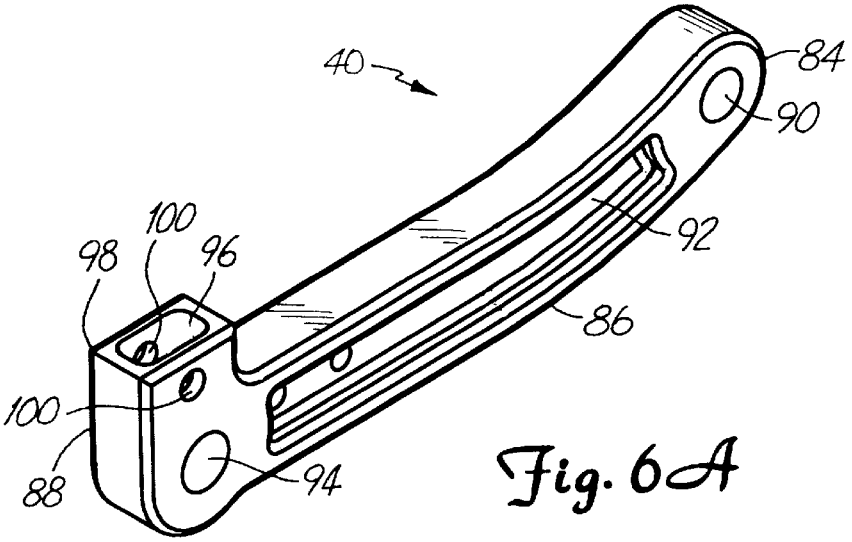
FIG. 6A is an enlarged perspective view of a wheel assembly lever arm.

FIG. 6A is an enlarged perspective view of the lever arm 40. The lever arm 40 is preferably a generally L-shaped body, and includes a hinge plate connection end 84, an intermediate portion 86 and a spring assembly connection end 88. In the preferred embodiment, the hinge plate connection end 84, the intermediate portion 86 and the spring assembly connection end 88 are of a singular construction. Further, the lever arm 40 is comprised of stainless steel material. However, other rigid materials, such as aluminum or hardened plastic, are acceptable substitutions.

Figure 6B:
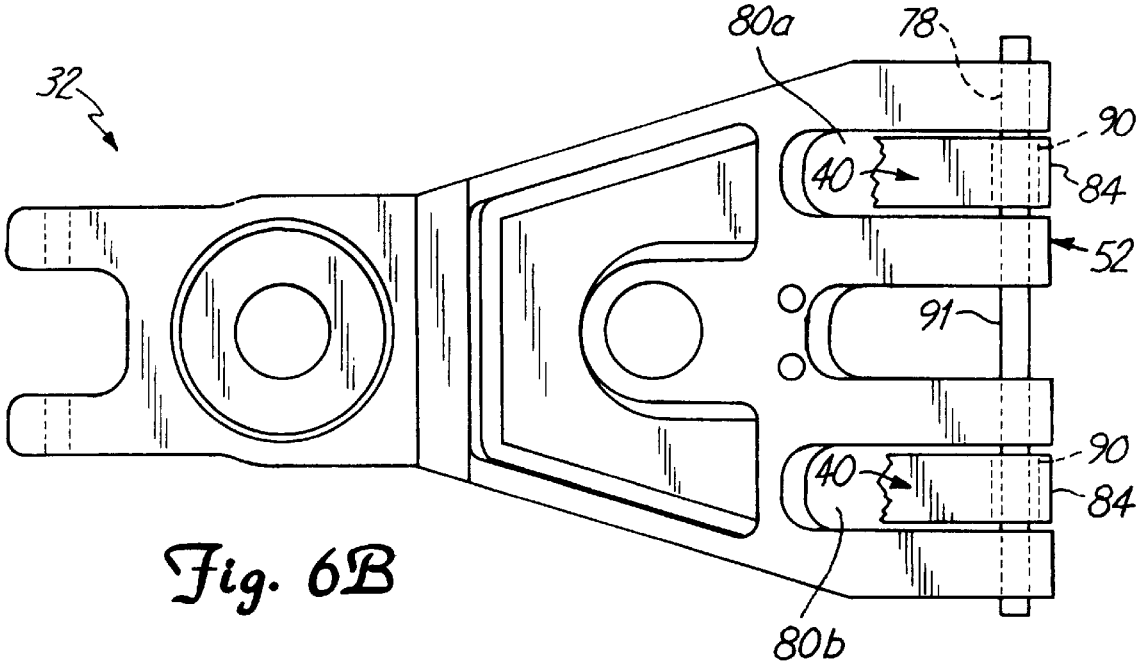
FIG. 6B is a top view of the hinge plate connected to two lever arms.

The hinge plate connection end 84 is sized to fit within one of the arm receiving areas 80*a* or 80*b* (FIG. 5B) of the hinge plate 32 (FIG. 5B), and includes a bore 90. The bore 90 preferably includes an oil lite bearing. As shown in FIG. 6B, the hinge plate connection end 84 of the lever arm 40 is positioned within the first arm receiving area 80*a* or the second arm receiving area 80*b* such that the bore 90 aligns with the dowel passageway 78 in the hinge end 52 of the hinge plate 32. A dowel 91 is passed through the dowel passageway 78 and the bore 90. With this configuration, the lever arm 40 can rotate with respect to the hinge plate 32, pivoting on the dowel 91.

The intermediate portion 86 extends from the hinge plate connection end 84 as shown in FIG. 6A. The intermediate portion 86 has a slight bend and includes a cavity 92. The slight bend is a design preference to reduce stresses on the lever arm 40 during use. The cavity 92 is provided to reduce required materials, and therefore reduce costs. The lever arm 40 will function equally as well without the slight bend or the cavity 92.

The hinge plate connection end 88 extends from the intermediate portion 86 as shown in FIG. 6A, and includes an axle passage 94, a spring receiving opening 96 defined by an outer wall 98, and a pair of pin openings 100. The axle passage 94 is sized to receive the central axle 51 (FIG. 3) of the wheel 28 (FIG. 3). The spring receiving opening 96 is sized to receive a portion of the spring assembly 38 (FIG. 3). Further details on the connection between the lever arm 40 and the spring assembly 38 is provided below.

Spring Assembly 38

Figure 7:
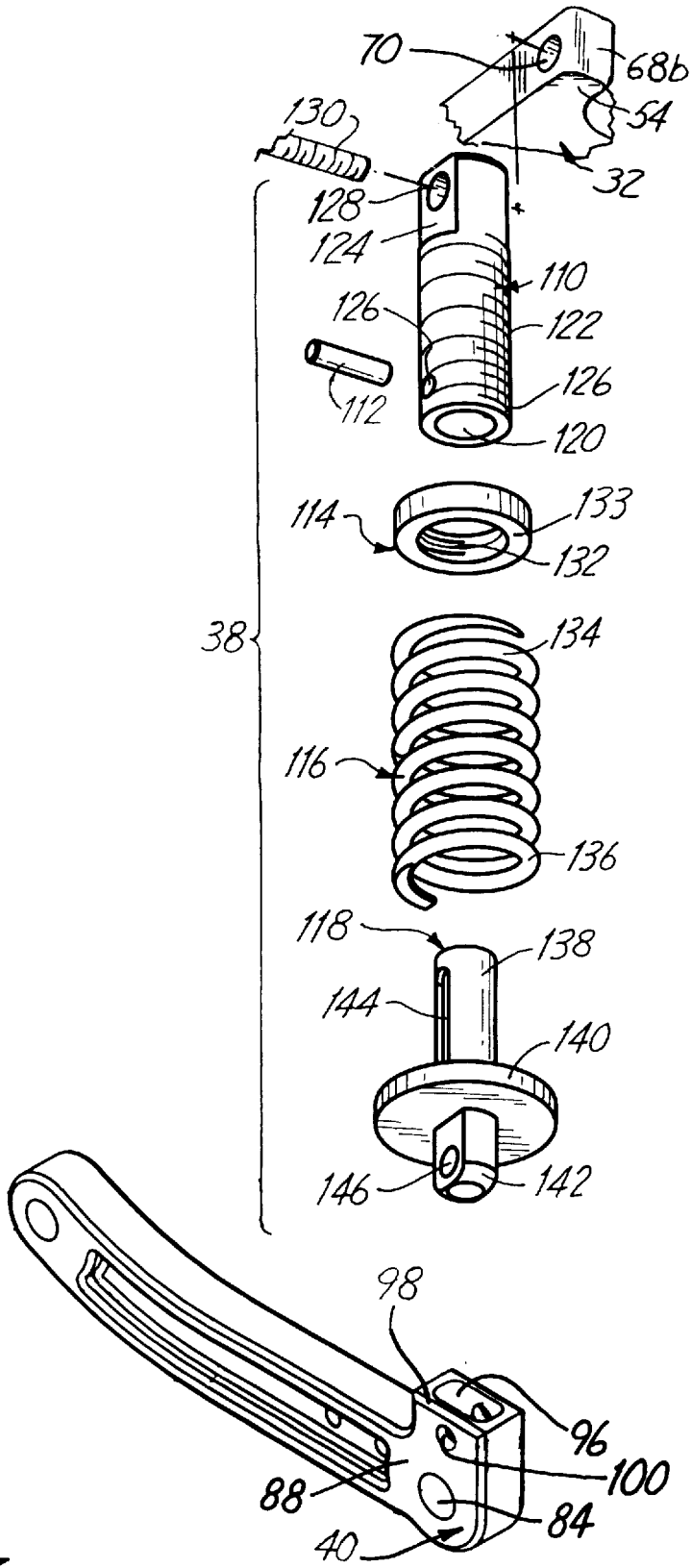
FIG. 7 is an enlarged, exploded view of a spring assembly of the wheel assembly shown in FIG. 3, including attachment to the hinge plate and lever arm.

FIG. 7 is an enlarged, exploded perspective view of the spring assembly 38 and provides further details on attachment of the spring assembly 38 to the hinge plate 32 and the lever arm 40. The spring assembly 38 includes a top housing 110, a retaining pin 112, an adjustment ring 114, a spring 116 and a bottom member 118.

The top housing 110 is a generally cylindrical-shaped, hollow body. The top housing 110 includes a central bore 120, an intermediate portion 122 and opposing shoulders 124. The intermediate portion 122 includes an exterior threaded surface and pair of pin holes 126 sized to receive the retaining pin 112. The opposing shoulders 124 include a transverse bore 128. In the preferred embodiment, the transverse bore 128 is threaded to receive a threaded stud 130 for connecting the spring assembly 38 to the suspension end 54 of the hinge plate 32. Similarly, the opposing shoulders 124 are sized such that the suspension end 54 of the hinge plate 32 can be maintained in flush engagement with top housing 110.

In the preferred embodiment the top housing 110 is aluminum. However, any other hard materials, such as stainless steel, are equally acceptable.

The retaining pin 112 is sized to pass through the pin holes 126 in the top housing 110. Further, the retaining pin 110 has a length approximately equal to the diameter of the intermediate portion 122 of the top housing 110. In the preferred embodiment, the retaining pin 112 is made from aluminum.

The adjustment ring 114 preferably includes an inner threaded surface 132 sized to threadably engage the intermediate portion 122 of the top housing 110. The adjustment ring 114 has an outer circumference that is greater than an outer circumference of the spring 116. This construction provides a bearing surface 133 for retaining the spring 116. The adjustment ring 114 is preferably made of stainless steel. However, aluminum or other hard materials are acceptable.

The spring 116 includes an upper end 134 and a lower end 136. The upper end 134 is preferably flat to seat against the bearing surface 133 of the adjustment ring 114. Similarly, the lower end 136 is preferably flat to seat against the bottom member 118. The spring 116 preferably has an inner diameter which is larger than an outer diameter of the top portion 110. However, the outer diameter of the spring 116 is smaller than the outer diameter of the adjustment ring 114. Thus, upon final assembly, the spring 116 rests or seats against the bearing surface 138 of the adjustment ring 114. In the preferred embodiment, the spring 116 is made from a stainless steel or titanium material.

The bottom member 118 includes a hollow shaft 138, a radial shoulder 140 and a foot 142. The hollow shaft 138 is a cylindrically shaped body, and includes an opposing pair of symmetrical slots 144. Notably, the bottom member 118 shown in FIG. 7 depicts only one of the pair of symmetrical slots 144. The hollow shaft 138 has an outer diameter sized to fit within the central bore 120 of the top housing 110. Further, the pair of symmetrical slots 144 are sized to receive the retaining pin 112. The radial shoulder 140 extends outwardly from the hollow shaft 138 and has an outer diameter larger than the diameter of the spring 116. Thus, the radial shoulder 140 is configured to maintain the lower end 136 of the spring 116. Finally, the foot 142 includes a passageway 146. The foot 142 is sized to nest within the spring receiving opening 96 in the lever arm 40. Further, the passageway 146 is located in the foot 142 such that when seated in the spring receiving opening 96, the passageway 146 aligns with the pair of pin openings 100 in the lever arm 40. In the preferred embodiment, the bottom member 118 is made from aluminum material.

The spring assembly 38 in constructed substantially as follows. The adjustment ring 114 is secured to the top housing 110 by threading the adjustment ring 114 onto the intermediate portion 122 of the top housing 110 to a position near the opposing shoulders 124. The spring 116 is placed over the intermediate portion 122 of the top housing 110 such that the upper end 134 of the spring 116 contacts the previously positioned adjustment ring 114. The bottom member 118 is secured to the top housing 110 by placing the hollow shaft 138 within the central bore 120 of the top housing 110. When properly positioned, the radial shoulder 140 of the bottom member 118 contacts the lower end 136 of the spring 116. Finally, the symmetrical slots 144 of the bottom member 118 are aligned with the pin holes 126 in the top housing 110. In this aligned relationship, the retaining pin 112 is passed through the pin holes 126 in the intermediate portion 122 and the symmetrical slots 144 in the hollow shaft 138. With this configuration, the retaining pin 112 prevents the bottom member 118 from disengaging the top housing 110 via expansion force of the spring 116. In other words, as the spring 116 acts to force the bottom member 118 away from the top housing 110, the retaining pin 112 contacts a top end of the symmetrical slots 144 to prevent disengagement. Once assembled, the compression of the spring 116 can be changed by relocating the adjustment ring 114 along the intermediate portion 122. The adjustment ring 114 and the radial shoulder 140 act to compress the spring 116 at the upper end 134 and the lower end 136, respectively. By positioning the adjustment ring 114 closer to the shoulder 124, the spring 116 compression is reduced. Thus, the spring 116 compression can easily be changed to accommodate users of varying weight and snowboarding experience.

Once assembled, the spring assembly 38 is connected to the hinge plate 32, a portion of which is shown in FIG. 7. Notably, for purposes of clarity, only one of the prongs 68*b* of the retaining end 54 for the hinge plate 32 is shown in FIG. 7. The top housing 110 of the spring assembly 38 is positioned so that one of the opposing shoulders 124 faces the prong 68*b* of the hinge plate 32. The threaded stud 130 is passed through the transverse bore 128 of the top housing 110 and into the prong 68*b*. The spring assembly 38 is then maneuvered along the threaded stud 130 until the prong 68*b* abuts one of the opposing shoulders 124.

The spring assembly 38 is also attached to the lever arm 40. With reference to FIG. 7, the foot 142 of the spring assembly 38 is placed within the spring receiving opening 96 of the lever arm 40. When properly positioned, the radial shoulder 140 rests on the outer wall 98 of the spring assembly connection end 88. In this position, the passageway 146 in the foot 142 aligns with the pair of pin openings 100. A pin (not shown) is passed through the pair of pin openings 100 and the passageway 146 to secure the foot 142, and thus the spring assembly 138, to the lever arm 40. The pin (not shown) is welded or otherwise secured in this position The above described mounting method provides a direct link between the hinge plate 32, the spring assembly 38 and the lever arm 40. When a force is placed on the lever arm 40 (such as by the wheel 28 shown in FIG. 3), this force is directly transposed through the spring assembly 38 to the hinge plate 32. However, the spring 116 itself acts as a dampener to offset any applied forces. The dampening effect of the spring 116 can be altered by selectively changing the spring 116 compression via position of the adjustment ring 114.

Wheel 28

Figure 8:
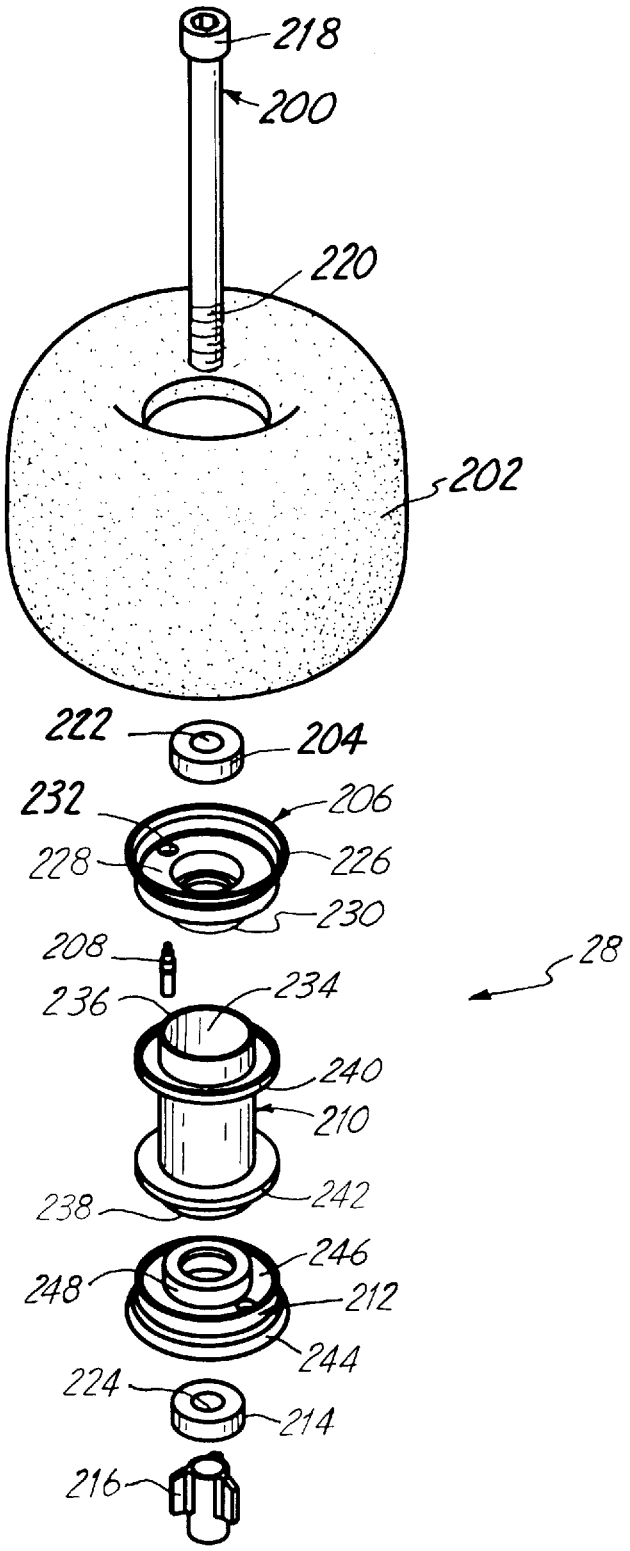
FIG. 8 is an exploded view of the wheel assembly shown in FIG. 3.

FIG. 8 is an exploded view of the wheel 28. The wheel 28 includes an axle 200 (shown as the central axle 51 in FIG. 3), an inflatable tire 202, a first bearing set 204, an outer cup 206, a valve 208, a hub 210, an inner cup 212, a second bearing set 214 and an indy nut 216.

The axle 200 includes a mounting end 218 and a threaded receiving end 220 that is sized to receive the indy nut 216. Further, the axle 200 is of a diameter sized to engage the first bearing set 204 and the second bearing set 214. In the preferred, the axle 200 is made of stainless steel.

Details of the inflatable tire 202 are provided below. However, the inflatable tire 202 is preferably made form reinforced rubber. Further, the inflatable tire preferably includes treads or knobs on an outer surface for providing enhanced traction during use.

The first and second bearing sets 204, 214 are identical and are configured to support the axle 200 when the inflatable tire 202 rotates. The first and second bearing sets 204, 214 are preferably made from stainless steel and include a plurality of ball bearings (not shown). The first and second bearing sets 204, 214, each include a central opening 222, 224, respectively, for receiving the axle 200. The first bearing set 204 has an inner diameter that is less than the diameter of the mounting end 218 of the axle 200. Similarly, the second bearing set 214 has an inner diameter that is less than the diameter of the indy nut 216.

The outer cup 206 includes a rib 226, a shoulder 228 and a flange 230. The shoulder 228 includes a passage 232 for securing the valve 208. Further, the shoulder 228 is recessed to seat the first bearing set 204. In the preferred embodiment, the outer cup 206 is machined from steel.

The valve 208 is preferably a standard grommet valve and is configured to extend through the passage 232 in the shoulder 228 of the outer cup 206. The valve 208 provides air from an outside forced air supply (not shown) to an interior of the inflatable tire 202.

The hub 210 is a tube which forms a central opening 234 defined by a first end 236 and a second end 238. The hub 210 further includes a first annular ring 240 near the first end 236 and a second annular ring 242 near the second end 238. The first end 236 is configured to receive the flange 230 of the outer cup 206. The second end 238 is similarly sized to receive the inner cup 212. In the preferred embodiment, the hub 210 is made from stainless steel.

The inner cup 212 includes a rib 244, a shoulder 246 and a flange 248. As shown in greater detail below, the shoulder 246 is recessed to seat the second bearing set 214. The flange 248 is sized to fit within the second end 238 of the hub 210. In the preferred embodiment, the inner cup 212 is machined from steel.

The indy nut 216 is interiorly threaded to mate with the threaded receiving end 220 of the axle 200. The indy nut 216 is preferably machined from steel.

Figure 9:
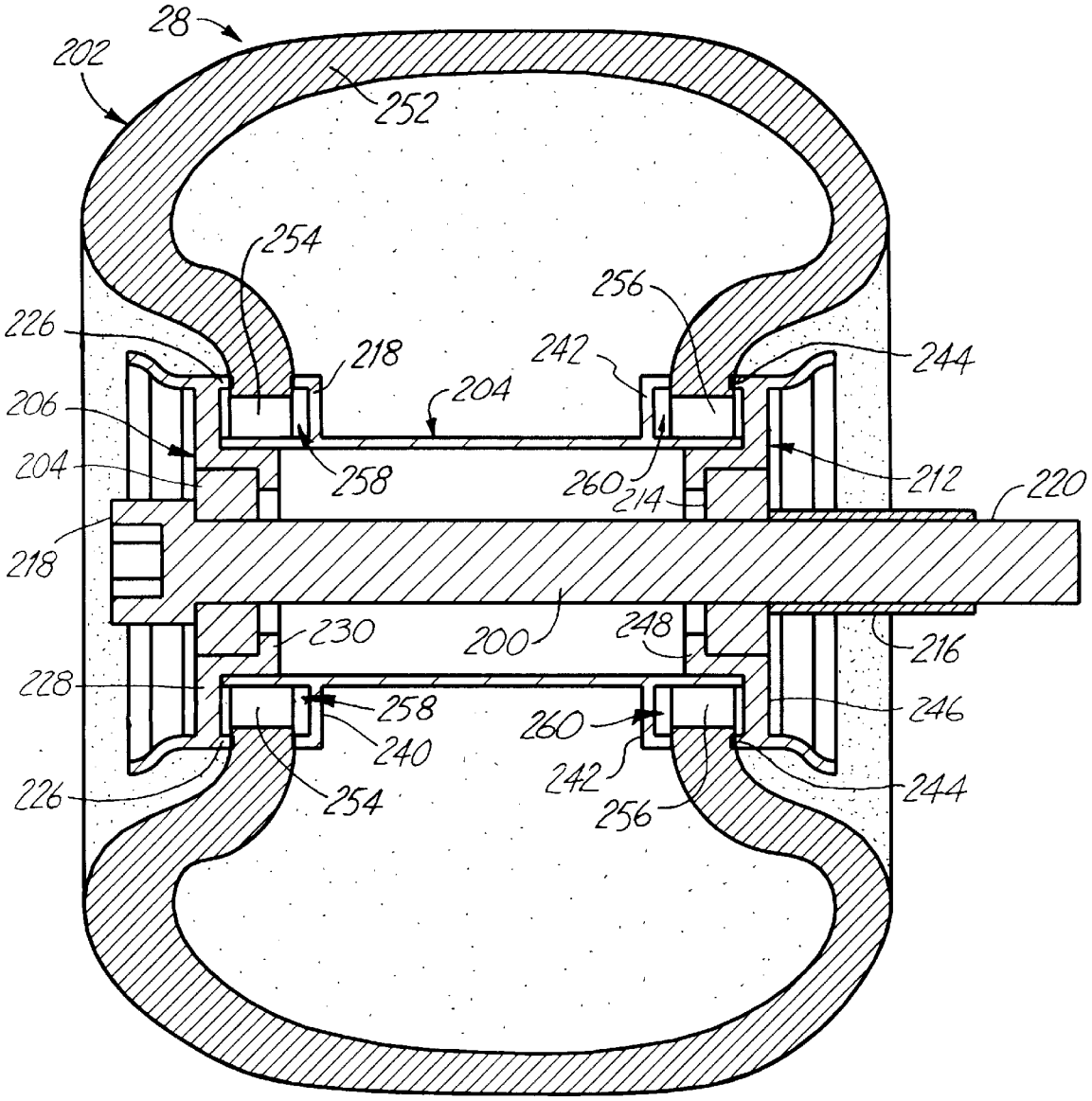
FIG. 9 is a side section view of the wheel assembly shown in FIG. 3.

As shown in FIG. 9, the wheel 28 is assembled by first loosely securing the outer cup 206 to the hub 210 via the flange 230. Similarly, the inner cup 212 is loosely secured to the hub 210 via the flange 248. (FIG. 8.) The first bearing set 204 is seated within a recess in the shoulder 228 of the outer cup 206. The second bearing set 214 is seated within a recess in the shoulder 246 of the inner cup 212. The axle 200 is directed centrally through the outer cup 206, the hub 210 and the inner cup 212, until the mounting end 218 abuts the first bearing set 204. The indy nut 216 is threaded onto the threaded receiving end 220 of the axle 200. The indy nut 216 is rotated along the threaded receiving end 220 until it abuts the second bearing set 214. With this configuration, the outer cup 206, the hub 210 and the inner cup 214 are tightened against one another by simply rotating the indy nut 216 along the axle 200 toward the mounting end 218. This action, in turn, forces the inner cup 212 (via the indy nut 216) toward the outer cup 206, which is maintained by the mounting end 218. With this arrangement, the outer cup 206, the hub 210 and the inner cup 214 comprise a unique, three-piece rim design.

The inflatable tire 202 is then attached to the three-piece rim. The inflatable tire 202 includes a body 252, an outer bead 254 and an inner bead 256. The beads 254, 256 are maintained by an outer receiving zone 258 and an inner receiving zone 260, respectively, formed by components of the outer cup 206, the hub 210 and the inner cup 212. In particular, the rib 226 of the outer cup 206 and the first ring 240 of the hub 210 form the outer receiving zone 258. The rib 244 of the inner cup 212 and the second ring 242 of the hub 210 form the inner receiving zone 260.

The outer receiving zone 258 receives the outer bead 254 of the inflatable tire 202. As the outer cup 206 is forced against the hub 210 by the mounting end 218 of the axle 200 (in response to tightening of the indy nut 216), the outer receiving zone 258 tightens about the outer bead 254. Thus, the rib 226 of the outer cup 206 and the first ring 240 of the hub 210 act in concert to pinch or otherwise secure the outer bead 254 of the inflatable tire 202.

Similarly, the inner receiving zone 260 receives the inner bead 256 of the inflatable tire 202. As the inner cup 212 is forced against the hub 210 by movement of the indy nut 216 along the axle 200, the inner receiving zone 260 tightens about the inner bead 256. Thus, the rib 244 of the inner cup 212 and the second ring 242 of the hub 210 act in concert to pinch or otherwise secure the inner bead 256 of the inflatable tire 202. Once secured, the inflatable tire 250 is inflated via forced air through the valve 208 (FIG. 8). Finally, the axle 200 is attached to the lever arm 40 (FIG. 3).

The three-piece rim configuration of the wheel 28 shown in FIGS. 8 and 9 is unique. This design provides for straightforward manufacture, along with a resulting structure able to withstand great forces. Unlike a standard skateboard wheel assembly, the wheel 28 will not break apart upon impact, as the components, including the outer cup 206, the hub 210 and the inner cup 212, are tightly secured to one another. The inflatable tire 202 can easily be replaced by simply loosening the indy nut 216 so as to release the outer bead 254 and the inner bead 256 from the outer receiving zone 258 and the inner receiving zone 260, respectively. The three-piece rim assembly 208, 210 and 212 works in concert with the inflatable tire 202 to evenly distribute side loads generated during turning maneuvers.

Perhaps even more importantly, the three-piece rim design of the wheel 28 allows for the use of the inflatable tire 202. Standard skateboards utilize a "wheel" made of a singular, hardened material, such as formed plastic. This hard plastic can easily break, and create an extremely rough ride. In contrast, the inflatable tire 202 provides an added cushion as the air absorbs various impacts. Further, a user can inflate the inflatable tire 202 to a desired pressure, thus optimizing performance.

Conclusion

The present invention provides a turf board uniquely designed for use on snowless terrain. The hinge plate portion of the wheel assembly allows true independent suspension. Each wheel can move independent of the other wheels, resulting in a smooth ride on extremely rough terrain. Further, due to the hinge plate design and attachment to the platform, large impacts will have no effect on the integrity of the turf board. The hinge plate provides the user with responsive turning as turning forces are applied directly to individual wheels. The wheel assemblies are further designed to have increased height, so that the platform rides well above most obstacles encountered on a snowless terrain. Finally, in the preferred embodiment, the three-piece rim includes an easy to assemble, inflatable tire design, never before available with a skateboard-like product. In fact, the three-piece rim design disclosed can be used with other wheeled devices, such as standard skateboards, in-line skates, etc.

Although the present invention has been described with reference to preferred embodiments, workers skilled in the art will recognize that changes may be made in form and detail without departing from the spirit and scope of the invention. For example, the spring assemblies have been described with great detail. However, other spring assembly constructions can be employed. Further, the spring assembly need not necessarily include a spring. Instead, the spring assemblies can simply be a cushion or other form of shock absorber.

What is claimed is:

1. A device for simulating snowboarding on snowless terrain, the device comprising:

a platform having an upper surface, a lower surface and means connected to the upper surface for securing the platform to a user; and a pair of spaced wheel assemblies connected to the lower surface of the platform, wherein each of the wheel assemblies comprises:

a pair of spaced lever arms having pivot ends pivotally connected to the first end of a hinge plate, each of the lever arms having base ends configured to carry a wheel;

a pair of spaced shock absorbers having first ends connected to the spaced lever arms, respectively, at a point spaced from the pivot ends, each shock absorber farther having second ends connected to the hinge plates; and a pair of wheels rotatably connected to the base ends, respectively, of the spaced lever arms.

2. The device of claim 1 wherein the first ends of the spaced shock absorbers are connected to the base ends, respectively, of the spaced lever arms.

3. The device of claim 1 wherein the hinge plate is configured such that the spaced lever arms are separately connected to the hinge plate to provide for independent suspension.

4. The device of claim 3 wherein the first end of the hinge plate includes a pair of spaced receiving areas, wherein each of the pair of spaced receiving areas is sized to receive the pivot end of one of the spaced lever arms.

5. The device of claim 1, wherein the wheel assemblies further comprise:

a base plate positioned between the lower surface of the platform and the hinge plate.

6. The device of claim 5 wherein the hinge plate further includes an intermediate portion disposed between the first end and the second end, and further wherein the hinge plate is connected to the base plate at the intermediate portion.

7. The device of claim 6, wherein the wheel assemblies further comprise:

a spud extending from the hinge plate for connection to the base plate; and a truck assembly positioned between the hinge plate and the base plate, wherein the spud and the truck assembly maintain a spaced, elastic relationship between the hinge plate and the base plate.

8. The device of claim 7 wherein the pair of wheels include an axle and further wherein the spud and the truck assembly are positioned on opposite sides of a plane defined by the axle.

9. The device of claim 8, wherein the truck assembly is orientated in approximately a same plane as the spaced shock absorbers.

10. The device of claim 6, wherein the first end of the hinge plate extends from the intermediate portion in an angular fashion.

11. The device of claim 1, wherein a one of the spaced lever arms is in a same plane as a one of the spaced shock absorbers.

12. The device of claim 1, wherein each of the spaced shock absorbers comprises:

a top housing for attachment to the hinge plate;

an adjustment ring attached to an outer surface of the top housing;

a spring having a first end and a second end, wherein the first end of the spring abuts the adjustment ring; and a bottom member movably secured to the top housing, wherein the bottom member includes a bearing surface for receiving the second end of the spring and a foot for attachment to one of the spaced lever arms.

13. The device of claim 1, wherein each of the pair of wheels comprises:

a rim comprising:

an outer cup having a rib and a central passage;

an inner cup having a central passage;

a hub having a first end, a second end and a central passage, wherein the first end of the hub includes an outer ring, and further wherein the outer cup abuts the first end of the hub such that the rib of the outer cup and the outer ring of the first end of the hub form a first receiving zone;

an axle passing through the central passages of the outer cup, the inner cup and the hub; and a tire having an outer bead secured within the first receiving zone.

14. The device of claim 13 wherein the inner cup includes a rib, wherein the second end of the hub includes an outer ring, and further wherein the inner cup abuts the second end of the hub such that the rib of the inner cup and the outer ring of the second end of the hub form a second receiving zone for securing an inner bead of the tire.

15. The device of claim 14 wherein the axle includes a mounting end sized to seat against the outer cup and a threaded end, the wheel further comprising:

an indy nut configured to interact with the threaded end of the axle and to seat against the inner cup, wherein the indy nut maintains the inner cup and outer cup in tight engagement with the hub.

16. A device for simulating snowboarding on snowless terrain, the device comprising:

a platform having an upper surface, a lower surface and means connected to the upper surface for securing the platform to a user; and a first wheel assembly and a second wheel assembly, the first and second wheel assemblies connected to the lower surface of the platform in a spaced relationship, each of the first and second wheel assemblies comprising:

a hinge plate including a first end and a second end;

a first lever arm and a second lever arm, wherein the first and second lever arms each have a hinge end and a base end, and further wherein the hinge end of each of the first and second lever arms is pivotally connected to the first end of the hinge plate;

a first shock absorber and a second shock absorber, wherein the first and second shock absorbers each have an upper end and a lower end, wherein the lower end of the first shock absorber is connected to the first lever arm at a point spaced from the hinge end and the upper end of the first shock absorber is connected to the second end of the hinge plate, and wherein the lower end of the second shock absorber is connected to the second lever arm at a point spaced from the hinge end and the upper end of the second shock absorber is connected to the second end of the hinge plate; and a pair of wheels, wherein one of the pair of wheels is connected to the first lever arm at the base end.

17. The device of claim 16 wherein the first end of the hinge plate includes spaced receiving areas, and further wherein the spaced receiving areas are configured to harness the first and second lever arms, respectively.

* * * * *